US007236606B2

(12) United States Patent
Werner

(10) Patent No.: US 7,236,606 B2
(45) Date of Patent: Jun. 26, 2007

(54) SOUND SYSTEM HAVING A HF HORN COAXIALLY ALIGNED IN THE MOUTH OF A MIDRANGE HORN

(75) Inventor: Bernard M. Werner, Los Angeles, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 818 days.

(21) Appl. No.: 10/093,186

(22) Filed: Mar. 7, 2002

(65) Prior Publication Data

US 2002/0150270 A1 Oct. 17, 2002

Related U.S. Application Data

(60) Provisional application No. 60/273,844, filed on Mar. 7, 2001.

(51) Int. Cl.
*H04R 1/02* (2006.01)

(52) U.S. Cl. ..... 381/342; 381/340

(58) Field of Classification Search ..... 381/342, 381/99, 337, 339, 340, 341, 343, 345, 346, 381/351; 181/152, 155, 156
See application file for complete search history.

(56) References Cited

U.S. PATENT DOCUMENTS

| | | | | |
|---|---|---|---|---|
| 4,893,695 | A | 1/1990 | Tamura et al. | |
| 5,125,732 | A * | 6/1992 | Jacobson et al. | 352/11 |
| 5,229,555 | A | 7/1993 | Inoue et al. | |
| 5,258,584 | A | 11/1993 | Hubbard | |
| 5,526,456 | A * | 6/1996 | Heinz | 381/340 |
| 5,872,339 | A | 2/1999 | Hanson | |
| 6,394,223 | B1 | 5/2002 | Lehman | |

* cited by examiner

*Primary Examiner*—Sinh Tran
*Assistant Examiner*—Brian Ensey

(57) ABSTRACT

A sound system is provided that groups a midrange horn with a high frequency ("H") horn. The sound system includes an HF horn coaxially coupled to a midrange horn, and two HF drivers aligned edge-to-edge. The sound system further includes two midrange drivers aligned edge-to-edge and coupled to the midrange horn. The edge-to-edge alignment of the two HF drivers is substantially perpendicular to the edge-to-edge alignment of the two midrange drivers. A method for grouping a plurality of midrange drivers and a plurality of high frequency drivers is also provided. This configuration may produce increased sound pressure levels while minimizing acoustic crossover interference problems.

32 Claims, 7 Drawing Sheets

SOUND SYSTEM HAVING A HF HORN COAXIALLY ALIGNED IN THE MOUTH OF A MIDRANGE HORN

CROSS REFERENCE TO RELATED APPLICATIONS

This application claims priority of U.S. Provisional Patent Application Ser. No. 60/273,844, filed on Mar. 7, 2001, the entirety of which is incorporated by reference in this application.

BACKGROUND OF THE INVENTION

1. Field of the Invention

This invention provides a sound system capable of grouping midrange and high frequency drivers together in an enclosure to increase the sound pressure level while minimizing interference problems.

2. Related Art

A sound system in a large spacious area such as an arena, outdoor, or stadium setting requires very high sound pressure levels (SPL) for adequate sound reproduction because of the long distances over which sound waves must travel in order to reach the listener. With the long distance, however, attenuation may develop in the sound waves. This may cause a drop of about 6 dB level of sound amplitude as sound waves travel twice the distances. Attenuation problems in the sound waves may be overcome by producing higher sound pressure levels at the origination of the sound. One way to do this is through grouping a number of loudspeakers together to increase the SPL.

When a group of loudspeakers generate sound there may be an overlapping in the coverage area. Overlapping sound waves, however, interfere with other sound waves. This can cause the overall SPL produced from the group of loudspeakers to be less than the SPL produced from the individual loudspeakers. For example, two sources or drivers generating overlapping patterns may increase the average SPL to about 3 dB over that of one of the two sound sources. By comparison, a coherent summation, where there is little or no interference between two sound sources, would increase the average SPL by about 6 dB over that of one of the two sound sources. Interference may also reduce the intelligibility and coherency of the sound because the sound waves may be arriving at the listener's ears at different times from different sound sources. Another problem may be reverberation within the auditorium due to sound waves bouncing off the walls, affecting the quality of the sound.

In an attempt to minimize the problems of grouping loudspeakers some have tried to incorporate two or three midrange drivers and two or three high frequency drivers into one enclosure. Such an arrangement helps to raise the SPL but there may still be a problem with interference as the drivers do not add up to produce the optimal SPL. Therefore, there still is a need for a sound system that may group midrange and high frequency (HF) drivers to increase the SPL while minimizing interference.

SUMMARY

A sound system is provided that groups a midrange horn with a high frequency ("HF") horn. This grouping may, for example, increase the sound pressure level ("SPL") of the sound system while minimizing interference problems. The sound system includes an HF horn coaxially coupled to a midrange horn, and two HF drivers aligned edge-to-edge.

The sound system further includes two midrange drivers aligned edge-to-edge and coupled to the midrange horn. The edge-to-edge alignment of the two HF drivers is substantially perpendicular to the edge-to-edge alignment of the two midrange drivers. The HF horn may, for example, have a throat within the midrange horn. The sound system may also include two slots merging to form a common exit, where the common exit is coupled to the throat of the HF horn and the two HF drivers are coupled to the two slots. A method for grouping a plurality of midrange drivers and a plurality of high frequency drivers is also provided.

As an example, an HF horn may be coaxially aligned within the mouth of a midrange horn. For example, the HF horn may include at least two HF drivers or transducers within the mouth of the midrange horn. Each of the two HF drivers may, in one example, have a vertical diffraction slot opening providing an exit for sound waves. The two diffraction slots from the HF drivers may be merged to form a common exit. The two diffraction slots may be adjacent to each other, together forming a throat. The two diffraction slots may be sized in terms of their height and width, with the vertical centerlines for each of the two diffraction slots spaced apart from each other, so that the acoustic output of the two diffraction slots may be fully coherent. In this configuration, the wave fronts from the two diffraction slots may be in phase so that summation of the acoustic wave fronts may occur at frequencies within a range of between 500 Hz to 20 kHz and at angles within the nominal horizontal and vertical coverage of the sound system.

The midrange drivers may be sized and spaced apart from each other so that their acoustic responses also combine in a fully coherent manner. In this configuration, a phase summation of the acoustic wave fronts may occur at frequencies within a range of between 100 Hz to 2 kHz and at angles within the nominal horizontal and vertical coverage of the sound system.

With the HF horn coaxially positioned within the mouth of the midrange horn, the size of the sound system may be reduced. This coaxial mounting may, for example, allow the off-axis interference (lobing) through the crossover region to be optimized equally in both the horizontal and vertical planes. As an example, two midrange drivers and two HF drivers may be arranged to sum coherently within the system's coverage angles. This arrangement may provide a 6 dB increase in the SPL as compared to a single driver, while minimizing acoustic crossover interference problems.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
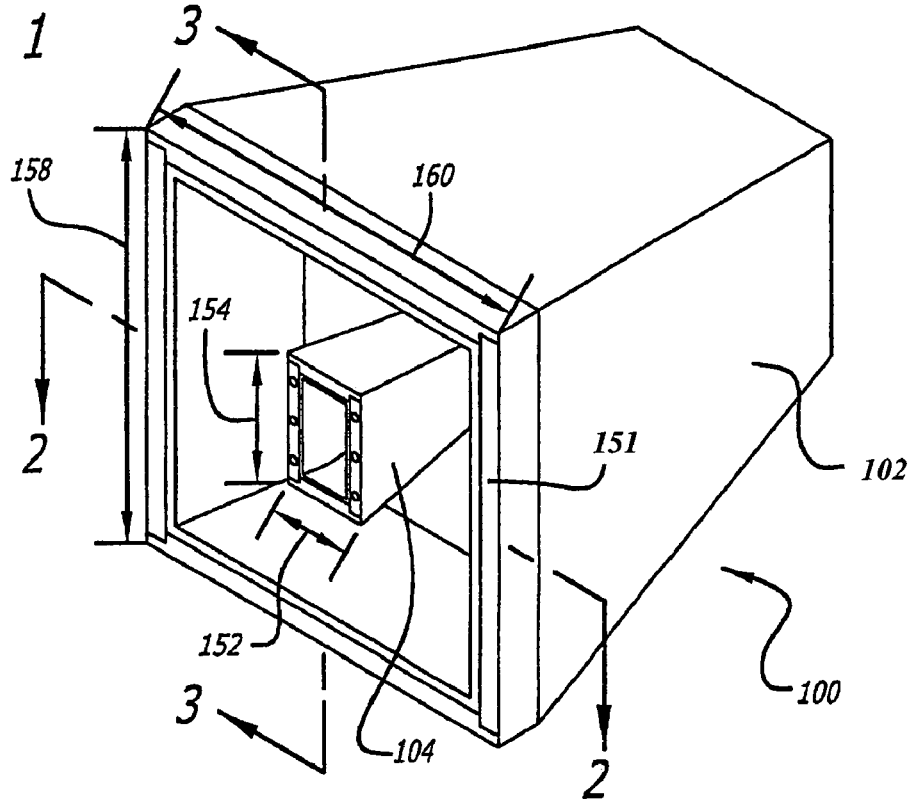
FIG. 1 is a front view of the sound system with a high frequency horn within a midrange horn.
Figure 2:
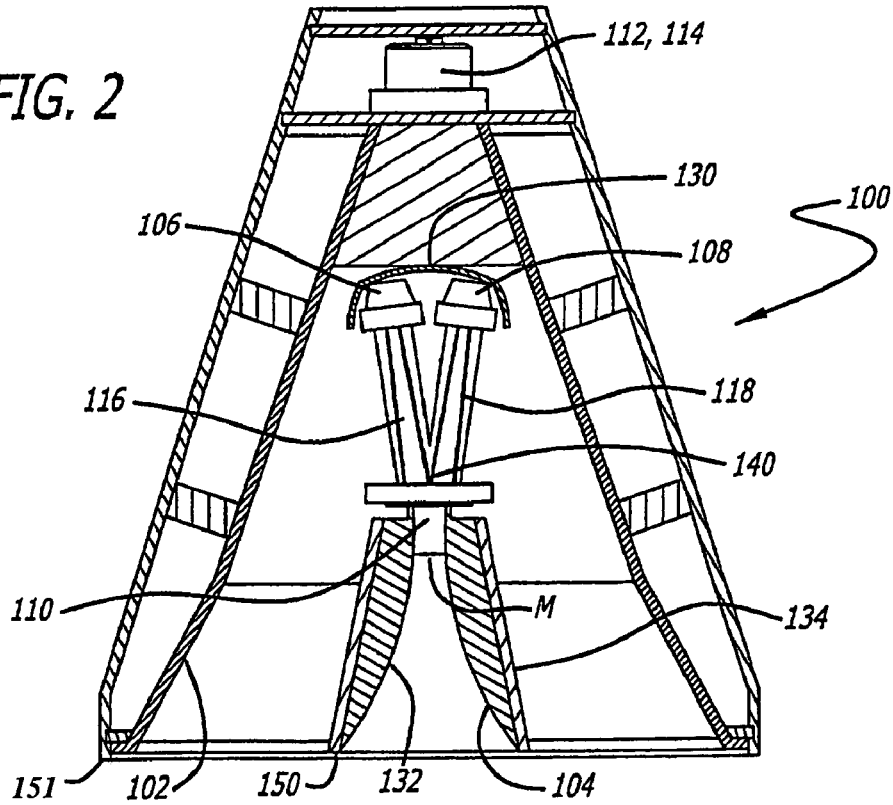
FIG. 2 is a cross-sectional view of the sound system along a line 2—2 of FIG. 1 showing a plurality of high frequency drivers.
Figure 3:
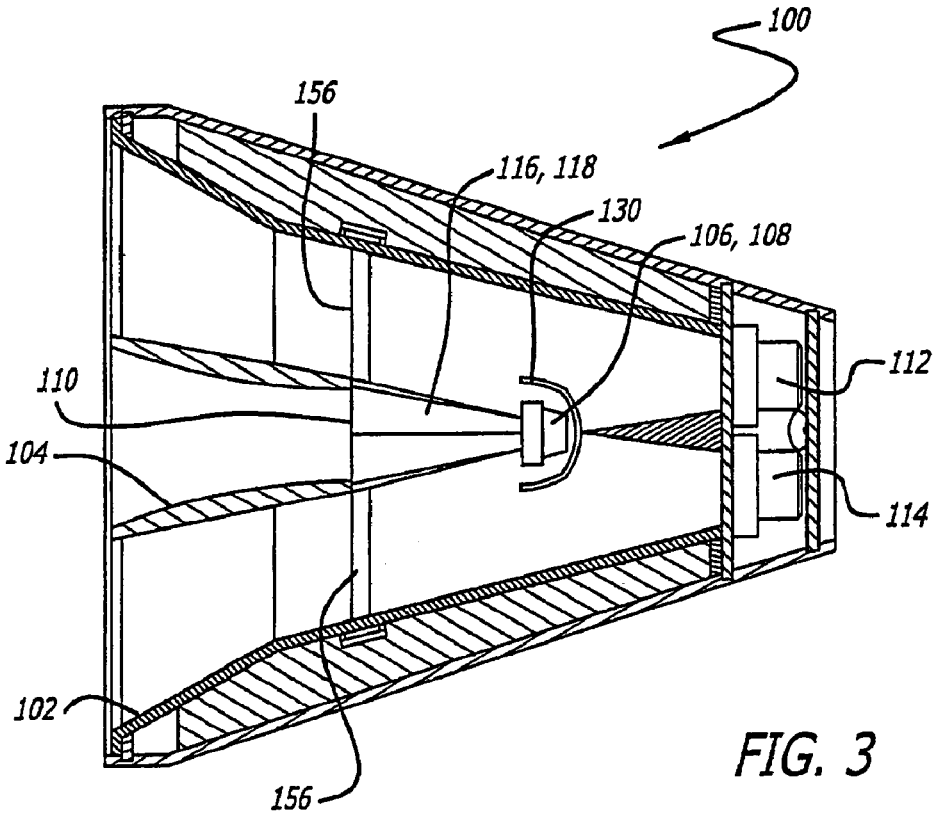
FIG. 3 is a cross-sectional view of the sound system along a line 3—3 of FIG. 1 showing a plurality of midrange drivers.

FIGS. 1 through 3 illustrate a sound system 100 incorporating a midrange horn 102 with a high frequency (HF) horn 104 that may increase the SPL while minimizing interference problems. FIG. 1 is a front view of the sound system 100 with high frequency horn 104 within midrange horn 102. FIG. 2 is a cross-sectional view of the sound system 100 along a line 2—2 of FIG. 1 showing a plurality of high frequency drivers 106, 108. FIG. 3 is a cross-sectional view of the sound system 100 along a line 3—3 of FIG. 1 showing a plurality of midrange drivers 112, 114. The sound system 100 may include the following features: (1) a HF horn 104 coupled to a plurality of high frequency drivers 106 and 108 where they sum or merge into a common throat 110 or wave guide; (2) coaxially mounting the midrange horn 102 with the HF horn 104, where the midrange horn 102 is coupled to a plurality of midrange drivers 112 and 114; and (3) mounting the plurality of midrange drivers 112 and 114 generally perpendicular to the plurality of HF drivers 106 and 108.

The HF horn 104 may be coaxially positioned within the mouth of the midrange horn 102. A number of channels 156 may be used to coaxially couple the HF horn 104 to the midrange horn 102. A plurality of diffraction slots 116 and 118 may be between the plurality of HF drivers 106, 108 and the HF horn 104. The plurality of diffraction slots 116 and 118 may couple the HF drivers 106 and 108 to the HF horn 104. The plurality of diffraction slots 116 and 118 may merge to form a common exit 140 that is adapted to mate with the common throat 110 of the HF horn 104.

The cross-section of the plurality of diffraction slots 116 and 118 may have a variety of shapes such as rectangular, square, triangular, oval, and circular. As the plurality of diffraction slots 116 and 118 merge, the common exit 140 may have a variety of cross-sectional shapes as well, such as rectangular, square, triangular, oval, and circular. The plurality of diffraction slots 116 and 118 may be sized so that the acoustical output of the plurality of diffraction slots 116, 118 may be fully coherent. In this configuration, the wave fronts from the plurality of diffraction slots 116, 118 may be in phase so that the summation of the acoustic wave fronts occurs at frequencies within a range of between about 500 Hz to about 20 kHz. The summation may also occur at angles within the nominal horizontal and vertical coverage range of the midrange and HF horns 102, 104.

The plurality of diffraction slots 116 and 118 may expand in area gradually from the HF drivers 106, 108 to the common throat 110 of the HF horn 104. The cross-sectional area may increase smoothly without discontinuities in the growth rate. The cross-sectional area may grow approximately in an exponential or other desirable manner. The HF horn 104 and the midrange horn 102 may expand gradually as well until they both form a HF lip 150 and a midrange lip 151, respectively. This allows the wave fronts from the HF drivers 106, 108 and midrange drivers 112, 114 to propagate in a smooth manner.

As illustrated in FIG. 2, the HF horn 104 may be configured so that it does not interfere with the expansion of the midrange horn 102 for proper acoustic loading. The HF horn 104 may be designed with both an interior surface 132 and a molded outer surface 134. The outer surface 134 may expand to maintain the area growth of the midrange horn 102 in an exponential manner. The space between the interior and outer surfaces 132 and 134 may be filled with urethane foam that provides structural rigidity and acoustic damping.

FIGS. 2 and 3 illustrate that the midrange horn 102 may be coupled to two midrange drivers 112 and 114, where the two midrange drivers 112 and 114 are aligned so that they are substantially perpendicular to the two HF drivers 106 and 108 that are aligned. The midrange drivers 112, 114 may be sized and spaced apart from each other so that the acoustic summed response may be fully coherent as well. For example, the centerline to centerline distance between the midrange drivers 112, 114 may be within a range of between about 6.5 inches (165 mm) to about 12 inches (305 mm); and in certain applications the centerlines of the two midrange drivers 112, 114 may be spaced about 8.5 inches (216 mm) apart. This arrangement allows the summation of the acoustic wave fronts to occur at frequencies within a range of between about 20 Hz to about 20 kHz. The summation of the wave fronts may also occur at angles within the nominal horizontal and vertical coverage range of the midrange horn 102. The midrange drivers 112, 114 may generate wave fronts with frequencies within a range of between about 20 Hz to about 3 kHz. The diameter of the midrange drivers 112, 114 may be about 8 inches (203 mm) as described in U.S. Pat. No. 5,748,760, the entirety of which is incorporated by reference in this application.

The HF drivers 106 and 108 may be placed close to the midrange drivers 112, 114 so the reflection of the wave fronts from the midrange drivers 112 and 114 off the backside of the HF drivers 106 and 108 is minimized. At higher frequency levels, wave fronts within a range of between about 500 Hz to 2.0 kHz from the midrange drivers 112 and 114 may reflect off the back of the HF drivers 106 and 108. This reflection may cause the sound waves to reflect back to the common throat of the midrange horn 102, causing aberration in the frequency and polar response. To minimize or eliminate such reflections, an acoustic throat damper 130 may be used to wrap around the HF drivers 106 and 108. The damper 130 may be specified to be moderately acoustically absorptive above 700 Hz, but not to be absorptive below 700 Hz. Hence, the portion of the wave fronts within a range of between 500 Hz to 2.0 kHz that would be reflected from the rear of HF drivers 106 and 108 are absorbed by the damper 130 rather than reflecting back into the midrange horn 102. The damper 130 may be constructed with an inside and outside shell of flame-retardant-treated and acoustically transparent woven fabric. The damper 130 may be made of fiberglass wool, grill cloth, Dacron, or any other material known to one skilled in the art.

Figure 4:
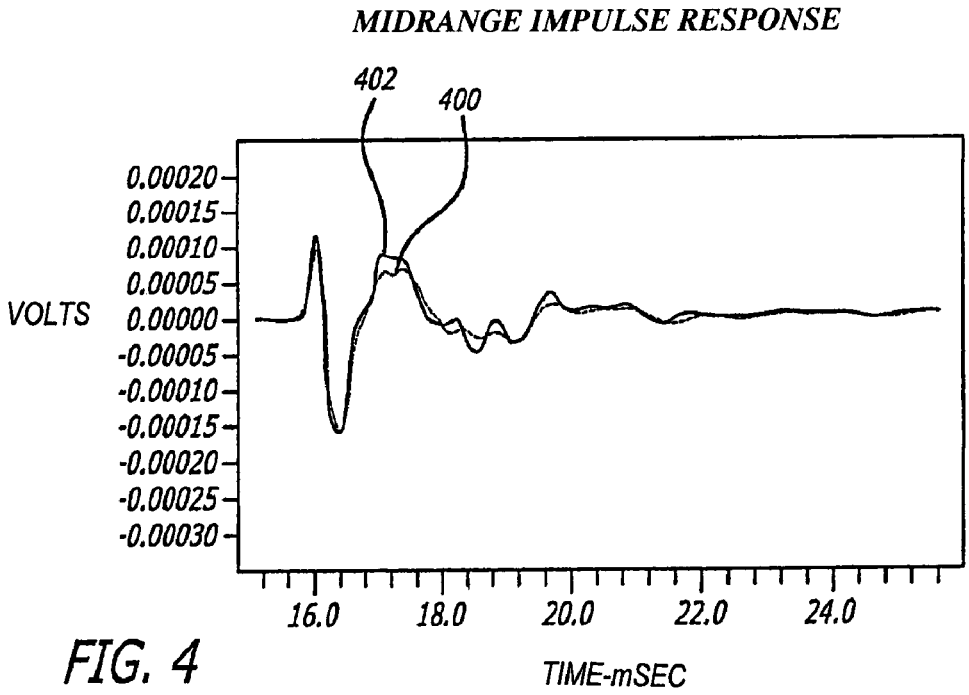
FIG. 4 is a graph of midrange impulse response with and without a damper covering the high frequency drivers of FIG. 2.

FIG. 4 is a graph that illustrates the midrange impulse response with and without the damper 130 covering the high frequency drivers 106, 108 of FIG. 2. The solid curve 400 indicates the response with the damper 130, and the dash curve 402 indicates the response without the damper 130. The solid curve 400 shows a smoother polar response and cleaner impulse response than the dash curve 402. FIG. 4 also indicates that since the damper 130 is absorptive above 700 Hz, there may be a net reduction in the SPL of about 1 dB within a frequency range of between about 1 kHz to 2 kHz. The damper 130 is optional depending on the application considering the trade off between the 1 dB reductions in the SPL versus smoother responses.

Shadowing may occur if the HF horn 104 blocks too much area of the midrange horn 102. This can cause the midrange horn 102 to behave as distinct "cells." When this happens, the midrange off-axis response may have nulls within the nominal coverage angle due to destructive interference of the acoustic energy produced by the distinct cells. This effect may be minimized by reducing the size of the HF horn 104. On the other hand, the size of the HF horn 104 needs to be large enough to maintain a pattern control at the crossover because the lower frequency limit of desirable pattern control may be limited by the mouth size of the HF horn 104.

Figure 5:
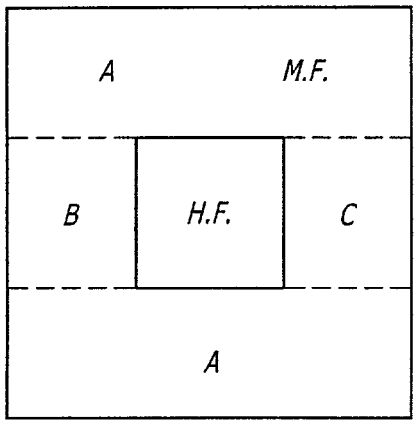
FIG. 5 is a front view of the sound system illustrating a radiating area that may be divided into three areas.
Figure 6:
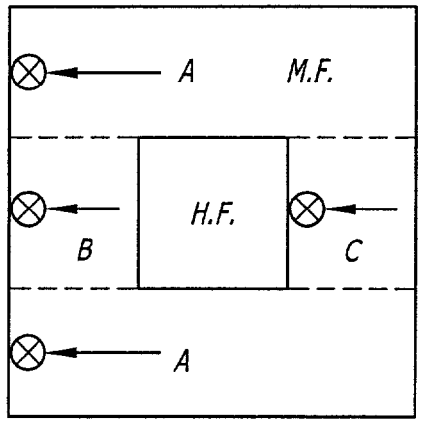
FIG. 6 is a front view of the sound system illustrating that as a listening location is moved to the left, the vectors that sound travels through move to the left.
Figure 7:
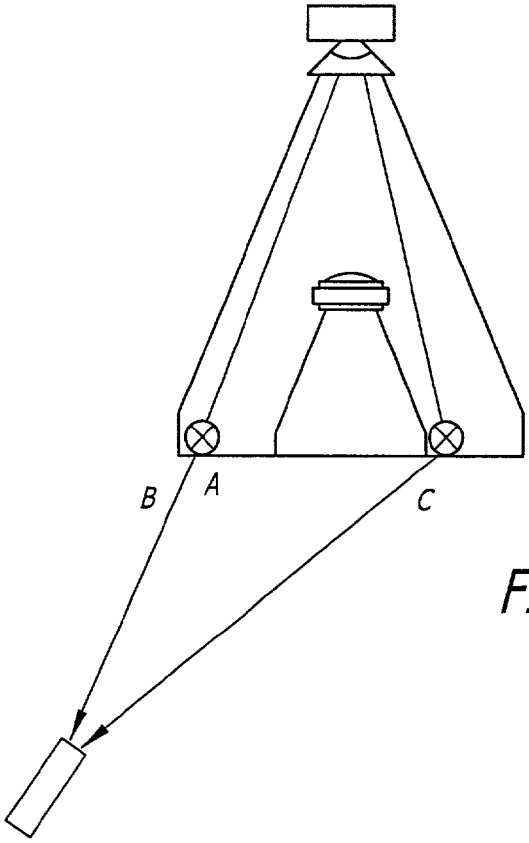
FIG. 7 is a top view of the sound system illustrating the vector moving to the left as shown in FIG. 6.

FIGS. 5 through 7 illustrate the effect of shadowing that causes the midrange horn ("M.F.") 102 to be divided into separate acoustical radiating areas. FIG. 5 is a front view of the sound system 100 illustrating a radiating area that may be divided into three areas. FIG. 6 is a front view of the sound system 100 illustrating that as listening location is moved to the left, the vectors that sound travels through move to the left. FIG. 7 is a top view of the sound system 100 illustrating the vector moving to the left as shown in FIG. 6. In this example there are three distinct areas defined by: two large areas labeled "A" formed above and below the HF horn 104 ("H.F."); and two smaller areas "B" and "C" formed on both sides of the HF horn 104. FIGS. 6 and 7 illustrate that the listening or measurement location may be moved to the left, as indicated by the left arrows. In such instances, sound must travel through the vector (X) shifted to the sidewall of the HF horn 104. At this angle of observation, acoustic energy originating from areas "A" and "B" may be in the same vertical plane, but energy arriving from area "C" may be offset in time. If the "shadowed" area or area "C" is too large, then the difference in arrival time may cause narrowing of the beamwidth, and visible lobing in the polar response may occur. Similarly, the same effect may occur in the vertical plane.

The effect of shadowing may be minimized if the height 154 and width 152 of the HF horn 104 are within a range of between about 0.25 to about 0.4 as large as the height 158 and width 160 of the midrange horn 102, respectively. This means that the masked area "C" may be within a range of between about 13% to about 19% as large as the total radiating area of the midrange horn 102. For 13% masked area and 19% mask area, there may be about 2 dB and about 4 dB maximum variations in response, respectively, assuming the following: (1) the intensity of the sound field is uniform across the radiating area of the midrange horn 102; and (2) the energy radiating from the "shadowed" zone is shifted 180° out-of-phase compared to the primary arrival of energy at some frequencies. If the HF horn 104 is not square, then the percentage of masking may be different. With reference to FIGS. 1 through 3, the size ratio between the HF horn 104 versus the midrange horn 102 may be about 0.33 vertically, and about 0.28 horizontally.

The output from the two midrange drivers 112 and 114 may combine coherently so that the SPL may increase up to 6 dB in the coverage area. The midrange drivers 112, 114 may be JBL's 2250J Neodymium Differential Drive® having a diameter of about 200 mm (8 in.) that provides about 350 watt power handling, per transducer. Other midrange drivers with different diameters may be utilized. Using two 200 mm (8 in.) diameter midrange drivers 112, 114 allows the bandwidth of the drivers to extend to higher frequencies. The two smaller diameter midrange drivers 112, 114 may also be placed edge-to-edge where the centerline to centerline distance is within a range of between about 7 inches (178 mm) to 8¼ inches (210 mm) apart. This minimizes the off-axis interference in the dual driver system.

Figure 8:
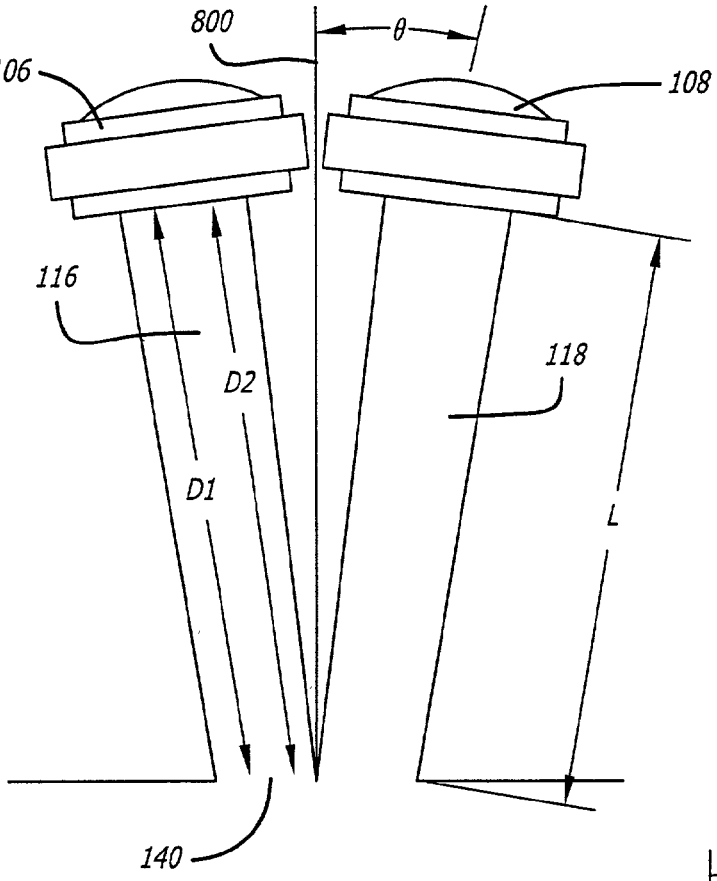
FIG. 8 is a top cross-sectional view of two high frequency drivers coupled to two slots merging into a common exit.
Figure 9:
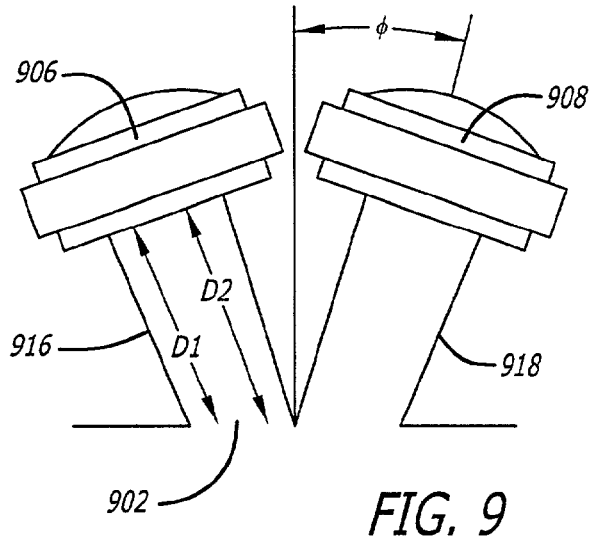
FIG. 9 is a top cross-sectional view of traditional drivers coupled to two slots.

FIG. 3 illustrates the midrange drivers 112, 114 aligned edge-to-edge vertically so that the HF drivers 106 and 108 may be located between the midrange drivers 112 and 114. Arranging the HF and midrange drivers 106, 108, 112, 114 in this configuration may reduce the masked area due to the HF drivers 106, 108 being in front of the midrange drivers 112, 114. The two HF drivers 106, 108 may be JBL's compression drivers Model 2430 or 2435, both commercially available from JBL, 8500 Balboa Blvd., Northridge, Calif. 91329, U.S.A. In this regard, U.S. Pat. No. 7,072,481, entitled Two-Stage Phasing Plug System in a Compression Driver, issued on Jul. 4, 2006, is incorporated in its entirety by reference in this application. The driver Model No. 2430 may be used with a diaphragm made of aluminum, and the driver Model No. 2435 may be used with a diaphragm made of beryllium. These HF drivers 106, 108 may be relatively small yet able to produce high acoustical output due to their efficiency, and they may generate wave fronts with a frequency within a range of between about 500 Hz to about 20 kHz. Both the 2330 and 2435 HF drivers 106, 108 may have a 4¼ inch (108 mm) diameter, a 3 inch (75 mm) diaphragm, and a height of about 2 and 5/16 inches (67 mm). In contrast, traditional large format high frequency compression drivers may have a diameter within a range of between 6.5 inches (165 mm) to 10 inches (254 mm). This means that the rear sides of the HF drivers 106 and 108 that face the midrange drivers 112, 114, have relatively smaller surface areas so that they minimize wave fronts from the midrange drivers 112 and 114 from reflection off the HF drivers 106 and 108. HF drivers 106, 108 having a diameter size of other than 5.5 inches (140 mm) may be used to minimize reflecting of the wave fronts from the midrange drivers 112, 114. FIG. 8 is a top cross-sectional view that illustrates two 4¼ inch diameter HF drivers 106 and 108 coupled to their respective diffraction slots 116 and 118 merging into a common exit 140. FIG. 9 is a top cross-sectional view illustrating two traditional HF drivers 906 and 908 having a diameter within a range of between 6.5 inches (165 mm) to 10 inches (254 mm) coupled to their respective diffraction slots 916 and 918. Because of the larger diameter of traditional HF drivers 906 and 908, the half-included angle ϕ for diffraction slots 916 and 918 is greater than the half-included angle θ for the diffraction slots 116 and 118. This means that the offset arrival of the wave front at the common exit 140 (D2 minus D1) for the diffraction slots 116 and 118 is less than at the common exit 902. Accordingly, minimizing the included angle θ between the HF drivers 106, 108 also minimizes the path length difference (D2 minus D1) to the common exit 140. Using smaller HF drivers 106, 108 may reduce the half-included angle θ to minimize the path length difference.

Figure 10:
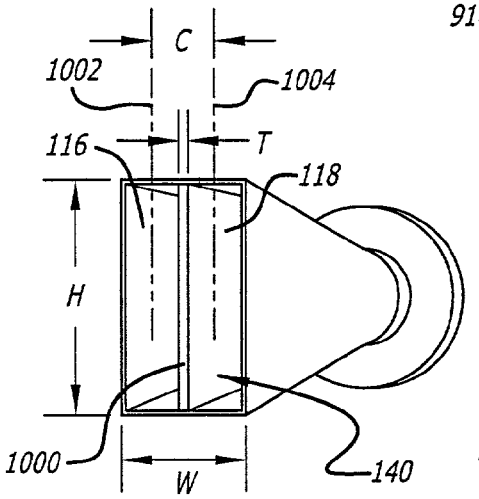
FIG. 10 is a perspective view of a common exit of two slots.

FIG. 10 is a perspective view illustrating two diffraction slots 116 and 118 merging to form a common exit 140. The total width "W" for the common exit 140 may be within a range of between about 0.75 inches (19 mm) to about 3.00 inches (76 mm); and the total height "H" may be within a range of between about 0.5 to 30.0 inches (13 mm and 762 mm). The distance "C" between the two centerlines 1002 and 1004 through the respective diffraction slots 116 and 118 may be within a range of between about 0.5 inches (13 mm) to 3.0 inches (76 mm). The common exit 140 may be divided by a wall 1000 having a thickness "T" that is within a range of between about 0.06 inches (2 mm) to about 0.25 inches (6 mm). As further illustrated in FIG. 8, the length "L" for the two diffraction slots 116 and 118 may be within a range of between about 4.0 inches (102 mm) to about 30.0 inches (762 mm). In particular, the length "L" may be about 11.0 inches (279 mm).

Using smaller diameter HF drivers 106 and 108 allows the two diffraction slots 116 and 118 to merge so that the distance "C" shown in FIG. 10 between the centerline 1002 to the centerline 1004 at the common exit 140 may be small. This allows the wave fronts from the two HF drivers 106 and 108 to sum coherently at the common exit 140. For example, referring to FIGS. 8 and 10, for the two diffraction slots 116 and 118 having the following dimensions: L=11 inches (279 mm); W=2.12 inches (54 mm); C=1.0 inch (25 mm); and T=0.12 inches (3 mm), the included angle θ between the primary axis 800 and the diffraction slots 116, 118 may be about 8.5°. This may reduce the offset in arrival of the wave front (D2 minus D1) at the common exit 140 to about 3.5 mm (0.14 in.). This may translate into about 63 μsec offset in arrival.

Figure 11:
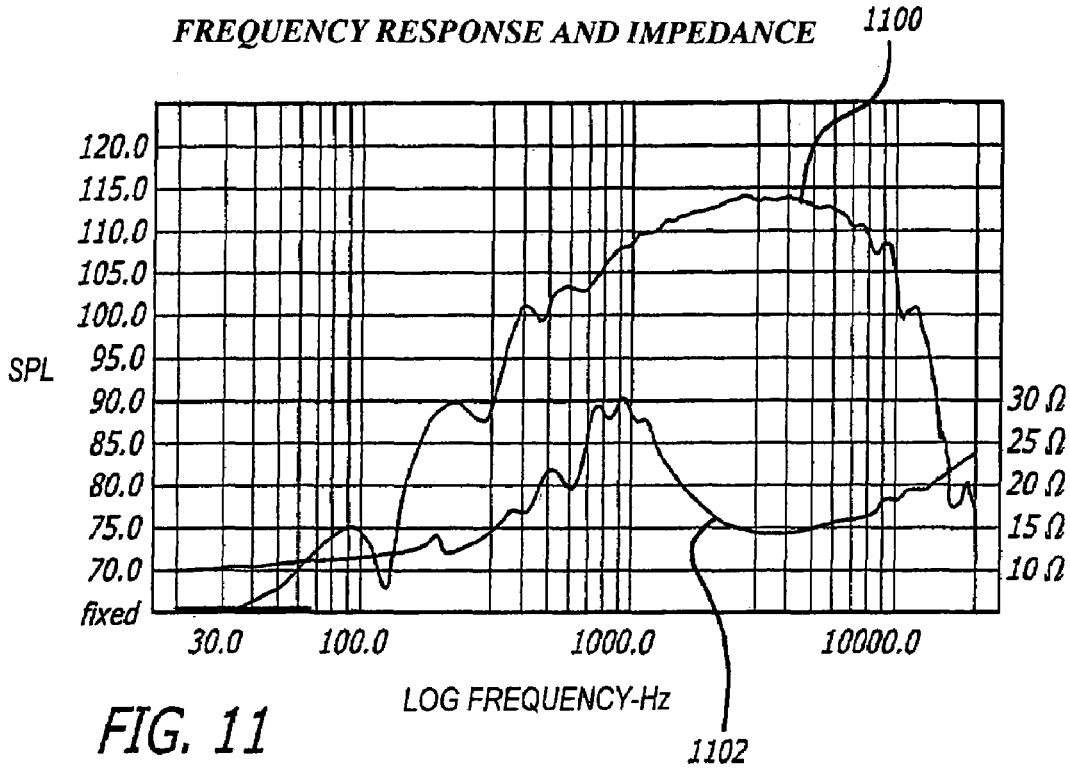
FIG. 11 is a graph of unprocessed frequency response and impedance curve of a high frequency horn.
Figure 12:
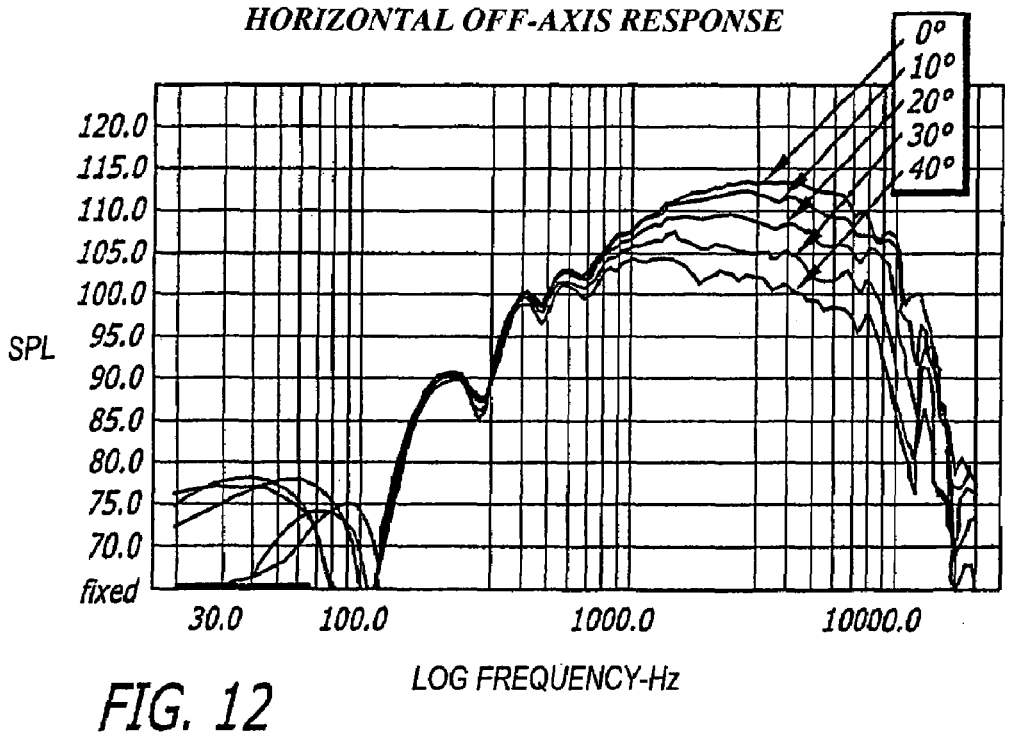
FIG. 12 is a graph of horizontal off axis response of a high frequency horn.

As illustrated in FIG. 2, the common exit 140 may be coupled to the common throat 110 of the HF horn 104. The curvature of the interior surface 132 may be smoothly curved in shape where the minimum horizontal width "M" may be about 45 mm (1¾ in.), that is within a range of between about 0 to about 6 inches (152 mm) in front of the common exit 140. The HF horn 104 integrates the two wave fronts from the two HF drivers 106 and 108 in a coherent fashion. FIG. 11 is a graph that illustrates an unprocessed frequency response curve 1100 and an impedance curve 1102 of the high frequency section. Note the smooth frequency response throughout the entire usable piston band of the HF drivers 106, 108. The response is substantially free of performance aberrations to frequencies above 11 kHz. FIG. 12 is a graph that shows the horizontal off-axis response for the same HF horn 104. These curves further illustrate that the two HF drivers 106 and 108 and the HF horn 104 behave substantially as a single unified signal source beyond 10 kHz at 0°, 10°, 20°, 30° and 40° off axis.

The sound system 100 may behave symmetrically through horizontal and vertical crossover regions. Such symmetry may provide a degree of freedom in the crossover design. In a non-coaxial system, where the HF horn 104 is displaced to one side of the midrange horn 102, the two pass bands may need to be in phase and at a level of −6 dB at the crossover point. For a symmetrical loudspeaker, however, the crossover region may be manipulated to optimize the system response both on and off axis to achieve substantially consistent frequency response at angles along the on and off-axis, horizontally and vertically.

Signal processing may improve the performance of the sound system 100. The performance may be improved by tuning a number of variables in a digital loudspeaker processor such as: (1) Crossover frequency; (2) High pass filter slope; (3) High pass filter type; (4) low pass slope; (5) low pass filter type; (6) interchannel delay; (7) polarity; and (8) all-pass filtering. Each of these variables may be optimized to yield a desired result. Tuning may be available through such processors as: JBL DSC-260, BSS Soundweb, and dbx Driverack.

Figure 13:
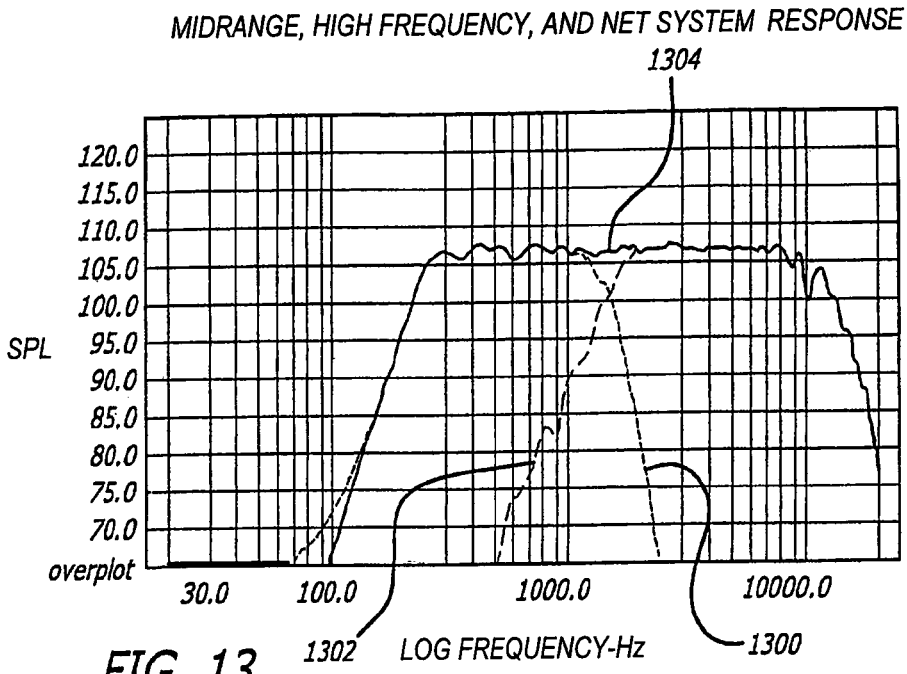
FIG. 13 is a graph of high-resolution frequency response of the processed midrange frequency band, high frequency band, and the net system response.

The filter slopes and alignments may allow the interaction between the pass-bands to be controlled. By determining the correct amount of interaction to occur at each frequency, the beamwidth, and directivity interaction between the pass-bands may be adjusted to assume the characteristic of either pass-band at each frequency. FIG. 13 is a graph that illustrates a high-resolution frequency response plot of the processed midrange frequency band 1300, high frequency band 1302, and the net system response 1304 for the sound system 100 using the signal processing. The net result is a clean system response 1304 based on the contribution from the midrange and high frequency bands 1300 and 1302.

Figure 14:
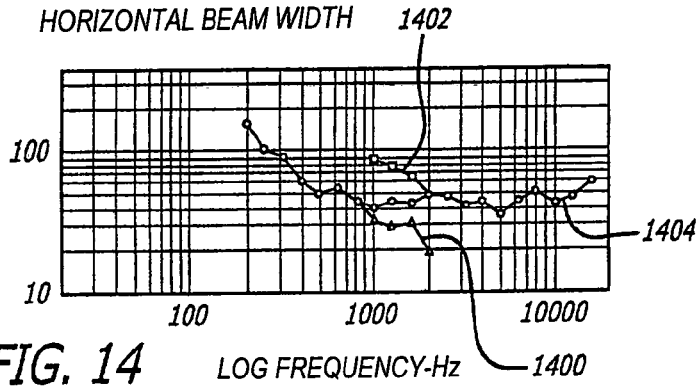
FIG. 14 is a graph of three horizontal beamwidth curves for unprocessed midrange and high frequency beamwidths, and a processed overall horizontal beamwidth of the system.

FIG. 14 is a graph that illustrates three horizontal beamwidth curves: unprocessed midrange section beamwidth 1400; unprocessed high frequency beamwidth 1402; and the overall horizontal beamwidth 1404 that has been processed to optimize the performance of the sound system 100. With the signal processing there is a more uniform angular and frequency response coverage.

Figure 15:
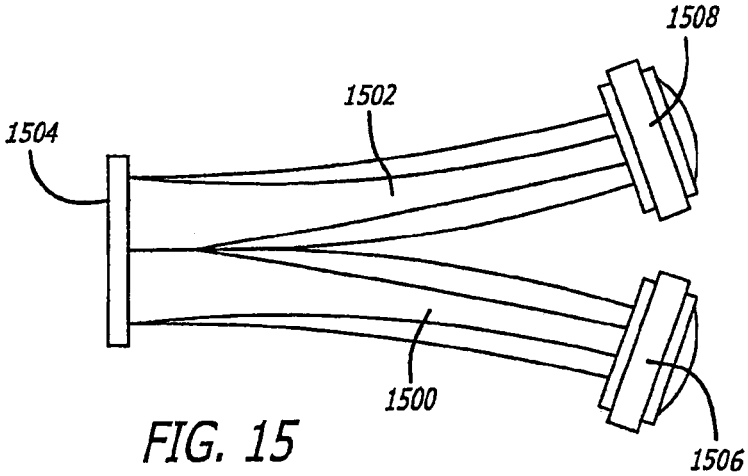
FIG. 15 is a top view of two diffraction slots that are curved.

Alternatively, as illustrated in FIG. 15, two diffraction slots 1500 and 1502 may be curved in certain applications to produce a flatter wave front as the common exit 1504. As the two curved diffraction slots 1500, 1502 merge they are more parallel with each other so that the wave fronts from the HF drivers 1506, 1508 may be flatter. This may be desirable depending on the required horizontal coverage angle. The radius of curvature of the two curved diffraction slots 1500, 1502 may be such that the two HF drivers 1506, 1508 are as close to each other as possible to minimize interfering with wave fronts from the midrange drivers 112, 114. The length of the two curved diffraction slots 1500, 1502 may determine the vertical coverage angle.

Figure 16:
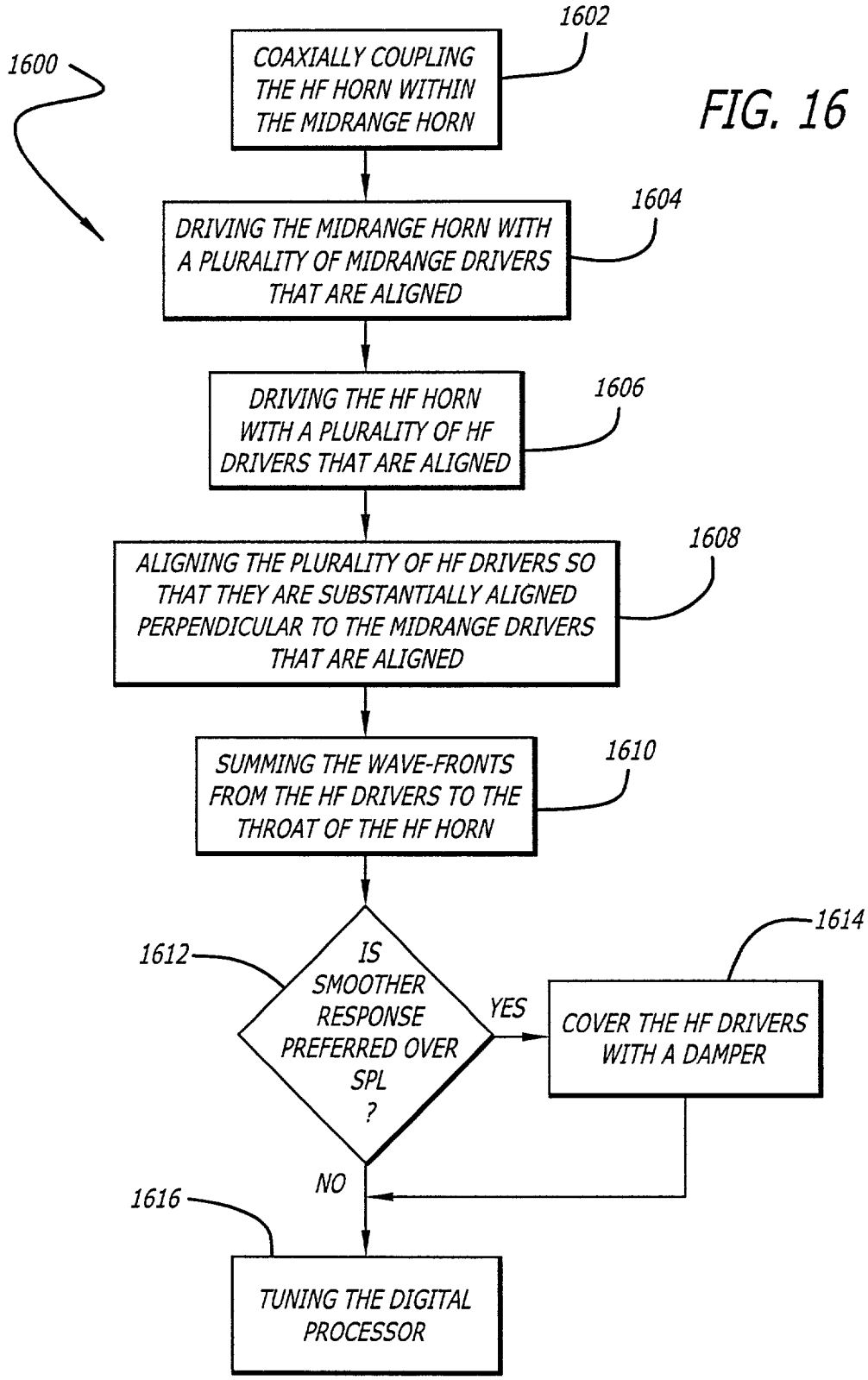
FIG. 16 is a flow chart of a method for grouping midrange and high frequency drivers together in an enclosure to increase sound pressure level while minimizing interference problems.

FIG. 16 is a flow chart that illustrates a method 1600 for grouping together a plurality of midrange drivers 112, 114 and a plurality of high frequency drivers 106, 108 in an enclosure to increase SPL while minimizing interference problems. In 1602, the HF horn 104 may be coaxially coupled to the midrange horn 102. In 1604, a plurality of midrange drivers 112 and 114 that are aligned may drive the midrange horn 102. In 1606, a plurality of HF drivers 106 and 108 may drive the HF horn 104 within the midrange horn 102. In 1608, the plurality of HF drivers 106, 108 may be aligned so that they are substantially perpendicular to the midrange drivers 112, 114 that are aligned. In 1610, the wave fronts from the plurality of HF drivers 106, 108 may be coherently summed into the throat of the HF horn 104. In 1612, if smoother response is selected over 1 dB reduction in SPL, then in 1614, a damper 130 may be used to cover the HF drivers 106, 108 so that the wave fronts above about 700 Hz which may reflect off HF drivers 106, 108 are absorbed rather than reflecting back off the HF drivers 106, 108. In 1616, a digital loudspeaker may be tuned to improve the performance of the sound system 100.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A sound system, comprising:

a high frequency (HF) horn coaxially coupled to a midrange horn, where the HF horn has a throat within the midrange horn;

two slots merging to form a common exit, where the common exit is coupled to the throat of the HF horn;

two midrange drivers aligned edge-to-edge and coupled to the midrange horn; and two HF drivers aligned edge-to-edge and coupled to the two slots, respectively, where the edge-to-edge alignment of the two HF drivers is substantially perpendicular to the edge-to-edge alignment of the two midrange drives.

2. The sound system according to claim 1, further including a damper covering the two HF drivers, where the damper is partially acoustically absorptive above about 700 Hz.

3. The sound system according to claim 1, where the cross-section of the common throat is rectangular.

4. The sound system according to claim 1, where the two slots expand smoothly in a cross-sectional area.

5. The sound system according to claim 1, where the HF horn and the midrange horn each have a height and a width, where the height and width of the HF horn is about 0.25 to about 0.4 ratio of the height and width of the midrange horn, respectively.

6. The sound system according to claim 1, where the HF horn has a HF lip and the midrange horn has a midrange lip, and where both the HF lip and the midrange lip have a rectangular shape.

7. The sound system according to claim 1, where an area between the HF horn and the midrange horn is a radiating area for the midrange horn, and to one side of the HF horn defines a mask area, where the mask area is about 13% to about 19% of the radiating area.

8. The sound system according to claim 1, where an area between the HF horn and the midrange horn is a radiating area for the midrange horn, and to one side of the HF horn defines a mask area, where the mask area is at least about 13% of the radiating area.

9. The sound system according to claim 1, where an area between the HF horn and the midrange horn is a radiating area for the midrange horn, and to one side of the HF horn defines a mask area, where the mask area is less than 19% of the radiating area.

10. The sound system according to claim 1, further including a signal processor for tuning the sound system.

11. A sound system, comprising:

a high frequency (HF) horn coaxially coupled within a midrange horn, where the HF horn is driven by a plurality of HF drivers that are aligned edge-to-edge; and a plurality of midrange drivers aligned edge-to edge and coupled to the midrange horn, where the edge-to-edge alignment of the plurality of HF drivers is substantially perpendicular to the edge-to-edge alignment of the plurality of the midrange drivers.

12. The sound system according to claim 11, further including a plurality of slots coherently summing wave fronts from the plurality of HF drivers to a throat of the HF horn.

13. The sound system according to claim 11, further including a damper adapted to cover the plurality of HF drivers and to be partially acoustically absorptive of wave fronts above about 700 Hz.

14. The sound system according to claim 12, where the throat has a rectangular shape.

15. The sound system according to claim 11, where the HF horn and the midrange horn each have a height and a width, where the height and width of the HF born is about 0.25 to about 0.4 ratio of the height and width of the midrange horn, respectively.

16. The sound system according to claim 11, where the HF horn bas a HF lip and the midrange horn has a midrange lip, where both the HF lip and the midrange lip have a rectangular shape.

17. The sound system according to claim 11, where an area between the HF horn and the midrange horn is a radiating area for the midrange horn, and to one side of the HF horn defines a mask area, where the mask area is about 13% to about 19% of the radiating area.

18. The sound system according to claim 12, further including two curved slots.

19. A sound system, comprising:

a high frequency (HF) horn coaxially coupled within a midrange horn, where the midrange horn is coupled to a plurality of midrange drivers that are aligned edge-to-edge;

means for driving a plurality of HF wave fronts toward the HF horn without substantially reflecting midrange wave fronts from the midrange drivers back into the midrange horn;

means for summing the plurality of HF wave fronts to a throat of the HF horn; and where the means for driving the plurality of HF wave fronts includes a plurality of HF drivers that are aligned edge-to-edge within the midrange horn, where the edge-to-edge alignment of the plurality of HF drivers is substantially perpendicular to the edge-to-edge alignment of the plurality of midrange drivers.

20. The sound system according to claim 19, further including means for partially acoustically absorbing the midrange wave fronts from the midrange drivers above about 700 Hz.

21. The sound system according to claim 19, where the means for summing the plurality of HF wave fronts comprises two slots merging to form a common throat with the throat of the HF horn, and where the two slots connect to the two HF drivers, respectively.

22. A method for grouping a plurality of midrange drivers and a plurality of high frequency drivers, comprising:

coupling coaxially a high frequency (HF) horn within a midrange horn;

driving the midrange horn with a plurality of midrange drivers that are aligned edge-to-edge;

summing wave fronts from a plurality of HF drivers to a throat of the HF horn, the plurality of HF drivers being aligned edge-to-edge; and edge-to-edge aligning the plurality of HF drivers substantially perpendicular to the edge-to-edge aliment of the plurality of midrange drivers.

23. The method according to claim 22, further including absorbing wave fronts above about 700 Hz from the plurality of midrange drivers around the plurality of HF drivers.

24. The method according to claim 22, further including tuning a digital loudspeaker processor to provide a clean system response.

25. The sound system according to claim 1, where the midrange horn has a lip, and the two HF drivers are between the two midrange drivers and the lip of the midrange horn.

26. The sound system according to claim 1, where the two HF drivers are in front of the two midrange drivers.

27. The sound system according to claim 1, where the two HF drivers are within the midrange horn.

28. The sound system according to claim 11, where the midrange horn has a lip, and the two HF drivers are between the two midrange drivers and the lip of the midrange horn.

29. The sound system according to claim 11, where the two HF drivers are in front of the two midrange drivers.

30. The sound system according to claim 11, where the two HF drivers are within the midrange horn.

31. The sound system according to claim 19, where the means for driving the plurality of HF wave fronts are two HF drivers that are in front of the plurality of midrange drivers.

32. The method according to claim 22, where the plurality of HF drivers are in front of the plurality of midrange drivers.

* * * * *